US005899280A

United States Patent [19]

Chouteau

[11] Patent Number: 5,899,280

[45] Date of Patent: May 4, 1999

[54] TILTING FRONT END LOADER

[76] Inventor: Dan L. Chouteau, Box 179 R.R. 1, Apt. #4, Ollogah, Okla. 74053

[21] Appl. No.: 09/022,366

[22] Filed: Feb. 12, 1998

[51] Int. Cl.[6] ..... E02F 3/76

[52] U.S. Cl. ..... 172/825; 172/831

[58] Field of Search ..... 172/825, 831, 172/824, 830, 823, 811, 822, 821, 828

[56] References Cited

U.S. PATENT DOCUMENTS

| | | | |
|---|---|---|---|
| D. 294,032 | 2/1988 | Whiffin . | |
| 2,185,015 | 12/1939 | Low | 172/824 X |
| 2,216,572 | 10/1940 | Nichols, Jr. | 172/825 X |
| 3,325,924 | 6/1967 | Peck, Jr. | 172/825 X |
| 3,337,974 | 8/1967 | Fisher | 172/824 |
| 3,662,841 | 5/1972 | Molby et al. | 172/824 |
| 3,705,631 | 12/1972 | Seaberg | 172/821 X |
| 3,774,696 | 11/1973 | Horsch | 172/825 |
| 3,795,280 | 3/1974 | Casey | 172/821 X |
| 3,926,263 | 12/1975 | Frisbee et al. . | |
| 4,019,588 | 4/1977 | Casey . | |
| 4,083,414 | 4/1978 | Yokoyama et al. . | |
| 4,147,218 | 4/1979 | Stedman | 172/825 |
| 4,337,837 | 7/1982 | Nissen | 172/825 X |
| 5,069,296 | 12/1991 | Horsch | 172/825 |
| 5,403,144 | 4/1995 | Staben, Jr. . | |
| 5,620,053 | 4/1997 | Kamikawa et al. | 172/821 X |

FOREIGN PATENT DOCUMENTS

| | | | |
|---|---|---|---|
| 204962 | 1/1968 | U.S.S.R. | 172/825 |

*Primary Examiner*—Christopher J. Novosad

[57] ABSTRACT

A tilting loader is provided including a pair of arms connected to a vehicle and adapted to raise and lower. Also included is a bucket including a rear portion having a rear face pivotally coupled to the arms. A tilt mechanism is included for rotating the bucket about a horizontally oriented central longitudinal axis in a counterclockwise direction. The tilt mechanism further rotates the bucket about a horizontally oriented central longitudinal axis in a clockwise direction.

4 Claims, 3 Drawing Sheets

TILTING FRONT END LOADER

BACKGROUND OF THE INVENTION

1. Field of the Invention

The present invention relates to front end loaders and more particularly pertains to a new tilting front end loader for working soil with various slopes and pitches while a tractor is on level ground.

2. Description of the Prior Art

The use of front end loaders is known in the prior art. More specifically, front end loaders heretofore devised and utilized are known to consist basically of familiar, expected and obvious structural configurations, notwithstanding the myriad of designs encompassed by the crowded prior art which have been developed for the fulfillment of countless objectives and requirements.

Known prior art front end loaders include U.S. Pat. No. 5,069,296; U.S. Pat. No. 4,083,414; U.S. Pat. No. 4,019,588; U.S. Pat. Des. 294,032; U.S. Pat. No. 5,403,144; and U.S. Pat. No. 3,926,263.

In these respects, the tilting front end loader according to the present invention substantially departs from the conventional concepts and designs of the prior art, and in so doing provides an apparatus primarily developed for the purpose of working soil with various slopes and pitches while a tractor is on level ground.

SUMMARY OF THE INVENTION

In view of the foregoing disadvantages inherent in the known types of front end loaders now present in the prior art, the present invention provides a new tilting front end loader construction wherein the same can be utilized for working soil with various slopes and pitches while a tractor is on level ground.

The general purpose of the present invention, which will be described subsequently in greater detail, is to provide a new tilting front end loader apparatus and method which has many of the advantages of the front end loaders mentioned heretofore and many novel features that result in a new tilting front end loader which is not anticipated, rendered obvious, suggested, or even implied by any of the prior art front end loaders, either alone or in any combination thereof.

To attain this, the present invention generally comprises a pair of arms each having an inboard extent pivotally coupled at an inboard end thereof to a side face of a vehicle. Associated therewith is an outboard extent pivotally coupled at an inboard end thereof to an outboard end of the corresponding inboard extent. The inboard extent and outboard extent are adapted to be pivoted upwards upon the receipt a raise signal and further downwards upon the receipt of a lower signal. For reasons that will become apparent hereinafter, the arms each have a predetermined amount of resilience. Next provided is a bucket including a rear portion having a rear face pivotally coupled to outboard ends of the outboard extents of the arms. Such is accomplished by way of a pair of universal ball and socket joints. During use, the bucket is adapted to curl in upon the receipt of a curl in signal and further curl out upon the receipt of a curl out signal. FIGS. 1 & 2 best show a rigid cross bar with a fixed length having a pair of ends. Such ends are pivotally coupled to a central extent of the outboard extents of the arms via a pair of universal ball and socket joints. With reference still to FIGS. 1 & 2, a hydraulic arm is provided having a first end pivotally coupled to the inboard end of the outboard extent of a first one of the arms via a ball and socket joint. A second end of the hydraulic arm is pivotally coupled to the outboard end of the outboard extent of a second one of the arms via a ball and socket joint. During use, the hydraulic arm is adapted to lengthen upon the receipt of a counterclockwise tilt signal. As such, the bucket is rotated about a horizontally oriented central longitudinal axis in a counterclockwise direction. In addition, the hydraulic arm serves to retract upon the receipt of a clockwise tilt signal for rotating the bucket about a horizontally oriented central longitudinal axis in a clockwise direction. Finally, a control unit includes a rotating lever mounted to a control panel of the vehicle. See FIG. 4. It should be understood that the control unit is connected to the arms, bucket and hydraulic arm. In use, the rotating lever functions to generate the raise and lower signal upon the lever being rotated to a 6 O'clock and 12 O'clock position, respectively. Further, the lever generates the counterclockwise tilt and clockwise tilt signal upon the lever being rotated to a 10 O'clock and 2 O'clock position, respectively. Lastly, the curl in and curl out signal are generated upon the lever being rotated to a 9 O'clock and 3 O'clock position, respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tilting front end loader apparatus and method which has many of the advantages of the front end loaders mentioned heretofore and many novel features that result in a new tilting front end loader which is not anticipated, rendered obvious, suggested, or even implied by any of the prior art front end loaders, either alone or in any combination thereof.

It is another object of the present invention to provide a new tilting front end loader which may be easily and efficiently manufactured and marketed.

It is a further object of the present invention to provide a new tilting front end loader which is of a durable and reliable construction.

An even further object of the present invention is to provide a new tilting front end loader which is susceptible of a low cost of manufacture with regard to both materials and labor, and which accordingly is then susceptible of low prices of sale to the consuming public, thereby making such tilting front end loader economically available to the buying public.

Still yet another object of the present invention is to provide a new tilting front end loader which provides in the apparatuses and methods of the prior art some of the advantages thereof, while simultaneously overcoming some of the disadvantages normally associated therewith.

Still another object of the present invention is to provide a new tilting front end loader for working soil with various slopes and pitches while a tractor is on level ground.

Even still another object of the present invention is to provide a new tilting front end loader that includes a pair of arms connected to a vehicle and adapted to raise and lower. Also included is a bucket including a rear portion having a rear face pivotally coupled to the arm means. A tilt mechanism is included for rotating the bucket about a horizontally oriented central longitudinal axis in a counterclockwise direction. The tilt mechanism further rotates the bucket about a horizontally oriented central longitudinal axis in a clockwise direction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
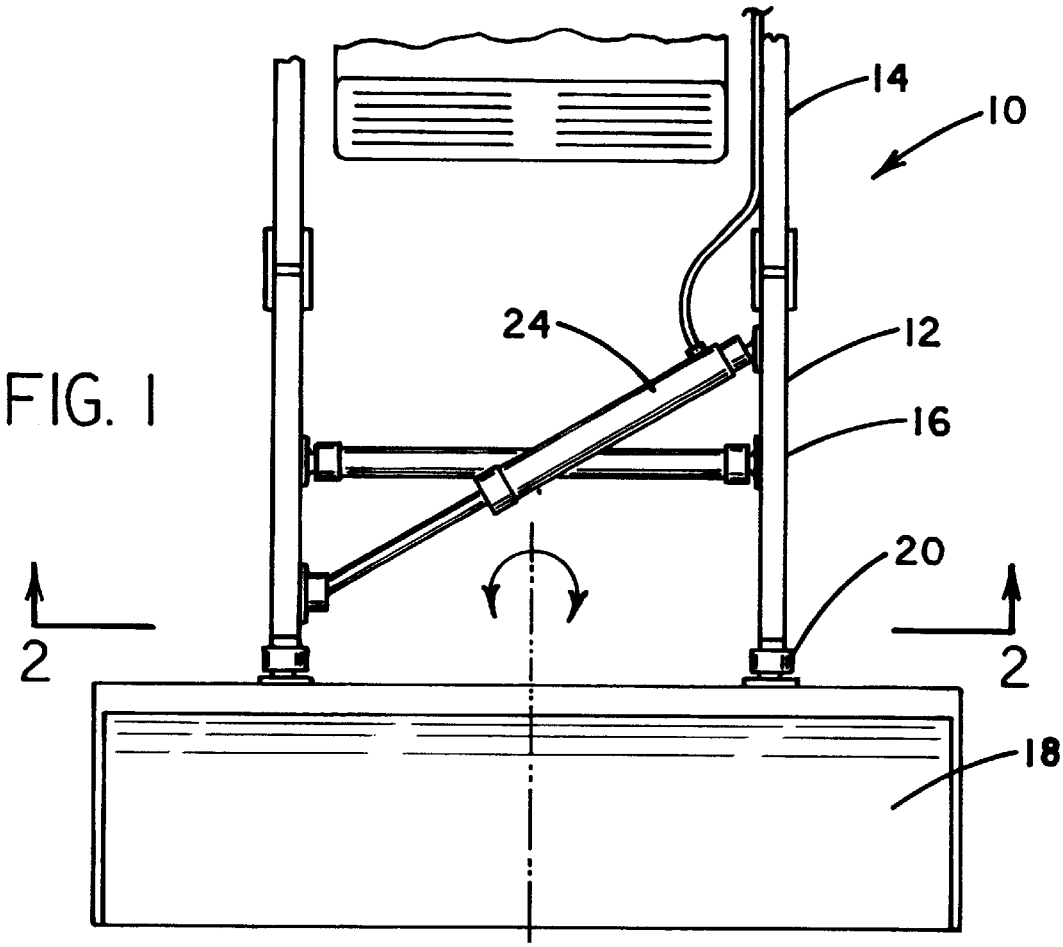
FIG. 1 is a front view of a new tilting front end loader according to the present invention.

With reference now to the drawings, and in particular to FIGS. 1 through 6 thereof, a new tilting front end loader embodying the principles and concepts of the present invention and generally designated by the reference numeral 10 will be described.

The present invention, designated as numeral 10, includes a pair of arms 12 each having an inboard extent 14 pivotally coupled at an inboard end thereof to a side face of a vehicle. For reasons that will become apparent, each inboard extent is spaced from the corresponding side face of the vehicle. Associated therewith is an outboard extent 16 pivotally coupled at an inboard end thereof to an outboard end of the corresponding inboard extent. The inboard extent and outboard extent are adapted to be pivoted upwards upon the receipt a raise signal and further downwards upon the receipt of a lower signal. For reasons that will become apparent hereinafter, the arms each have a predetermined amount of resilience.

Next provided is a bucket 18 including an open front and a rear portion having a rear face pivotally coupled to outboard ends of the outboard extents of the arms. Such is accomplished by way of a pair of universal ball and socket joints 20. During use, the bucket is adapted to curl in upon the receipt of a curl in signal and further curl out upon the receipt of a curl out signal. It should be noted that while not shown, the arms and bucket have associated dedicated hydraulics for accomplishing the foregoing functions in a convention manner.

Figure 2:
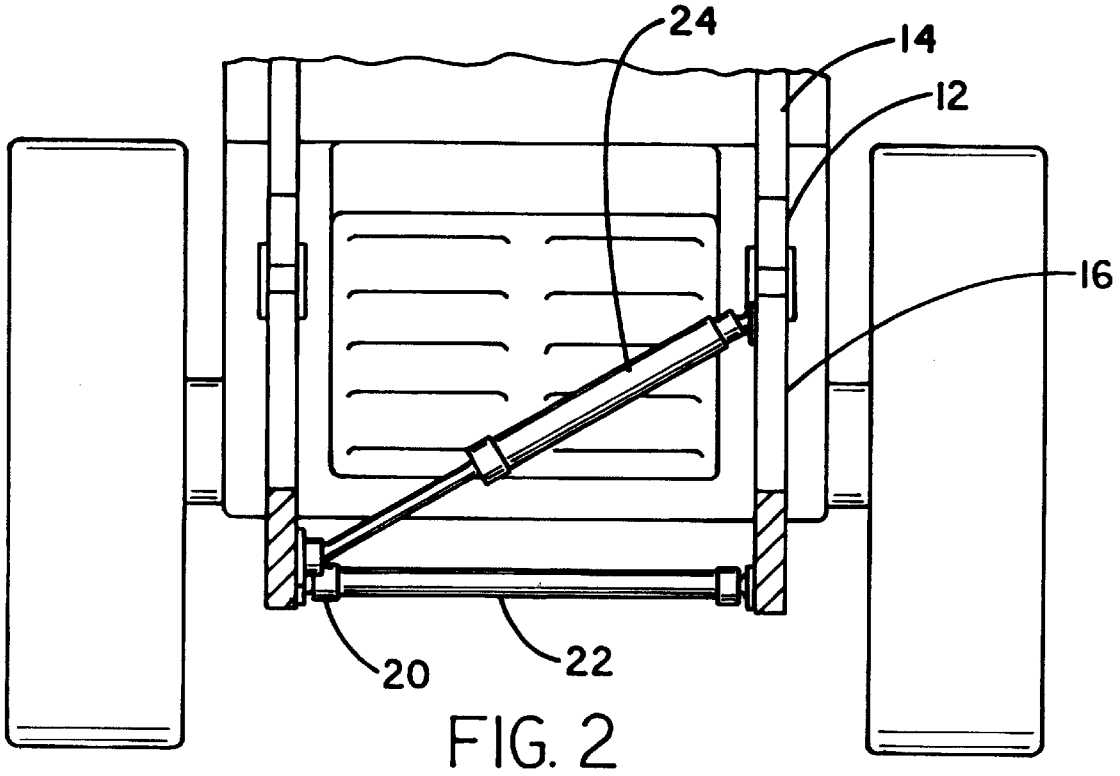
FIG. 2 is a cross-sectional view of the present invention taken along line 2—2 shown in FIG. 1.
Figure 3:
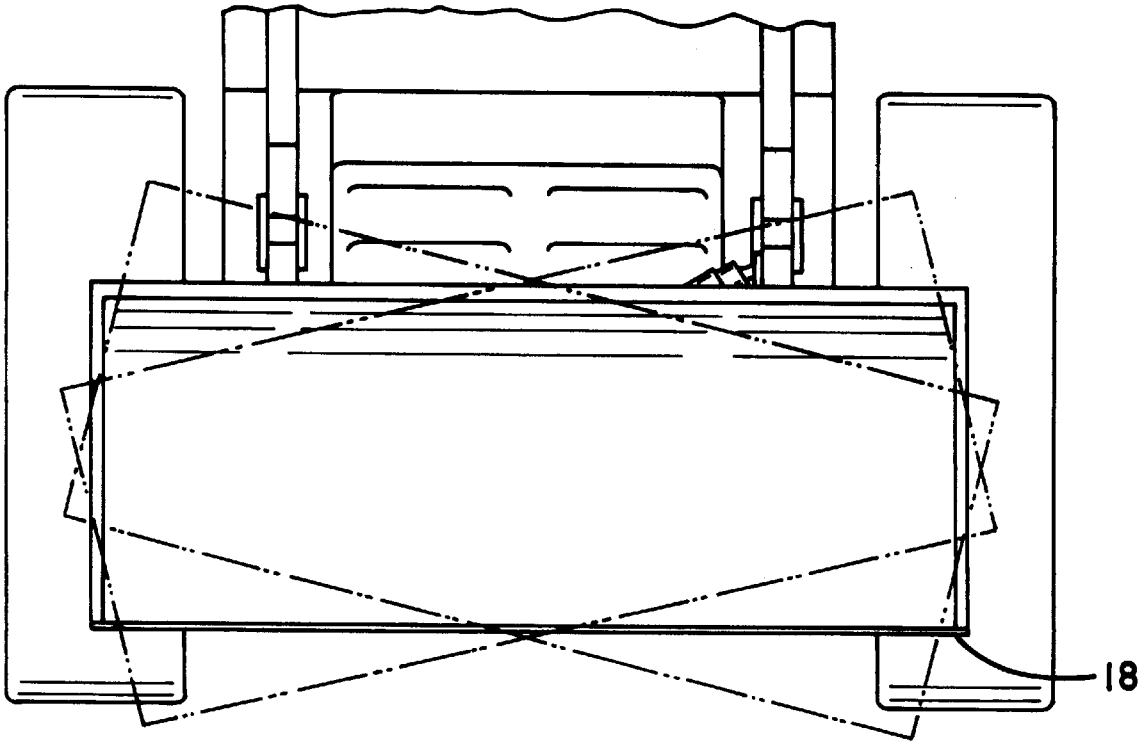
FIG. 3 is a front view of the present invention in use.
Figure 4:
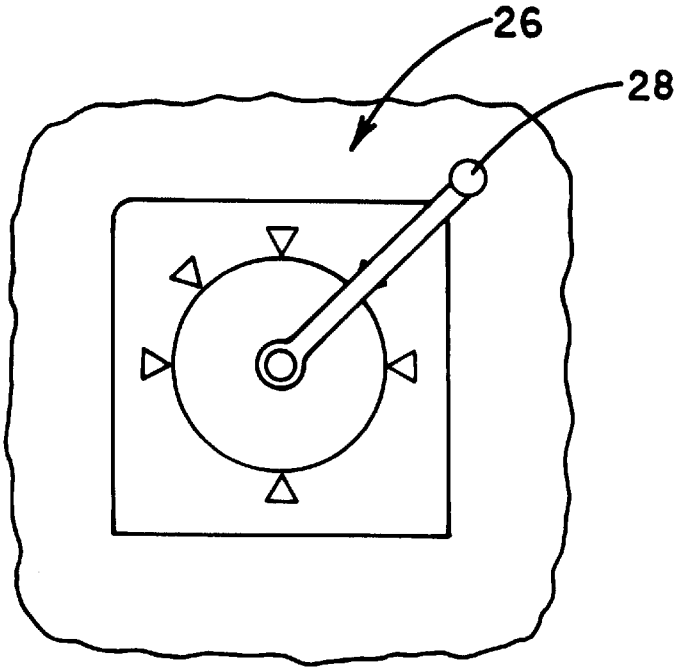
FIG. 4 is a front view of the control unit of the present invention.

FIGS. 1 & 2 best show a rigid cross bar 22 with a fixed length having a pair of ends. Such ends are pivotally coupled to a central extent of the outboard extents of the arms via a pair of universal ball and socket joints. Without the application of outside force, the cross bar resides in perpendicular relationship with the arms.

With reference still to FIGS. 1 & 2, a hydraulic arm 24 is provided having a first end pivotally coupled to the inboard end of the outboard extent of a first one of the arms via a ball and socket joint. A second end of the hydraulic arm is pivotally coupled to the outboard end of the outboard extent of a second one of the arms via a ball and socket joint.

During use, the hydraulic arm is adapted to lengthen upon the receipt of a counterclockwise tilt signal. As such, the bucket is rotated about a horizontally oriented central longitudinal axis in a counterclockwise direction. In addition, the hydraulic arm serves to retract upon the receipt of a clockwise tilt signal for rotating the bucket about a horizontally oriented central longitudinal axis in a clockwise direction. See FIG. 3. It should be noted that the longitudinal axis resides along a direction of straight travel of the vehicle.

Finally, a control unit 26 includes a rotating lever 28 mounted to a control panel of the vehicle. See FIG. 4. It should be understood that the control unit is connected to the arms, bucket and hydraulic arm. In use, the rotating lever functions to generate the raise and lower signal upon the lever being rotated to a 6 O'clock and 12 O'clock position, respectively. Further, the lever generates the counterclockwise tilt and clockwise tilt signal upon the lever being rotated to a 10 O'clock and 2 O'clock position, respectively. Lastly, the curl in and curl out signal are generated upon the lever being rotated to a 9 O'clock and 3 O'clock position, respectively. The aforementioned signals refer to hydraulic pressure differentials which effect the desired function.

Figure 5:
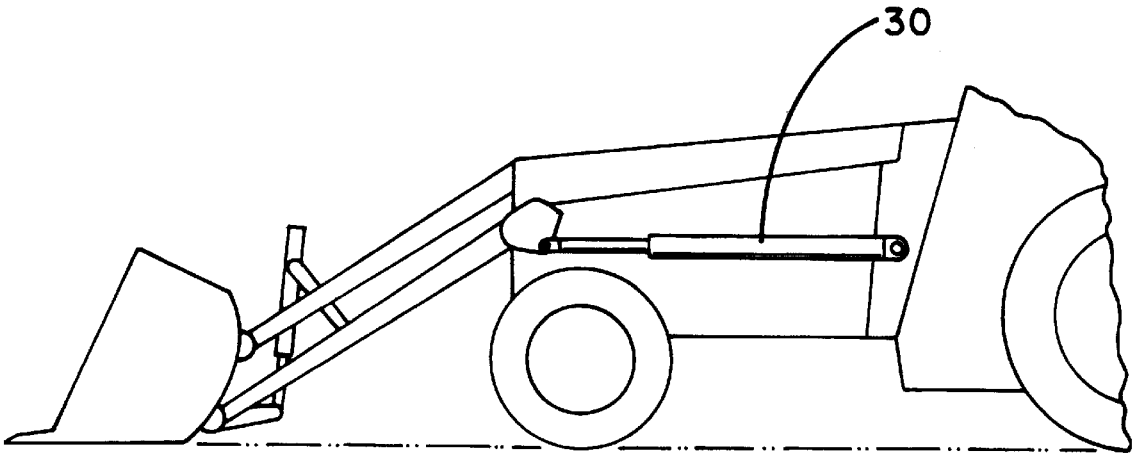
FIG. 5 is a side view of an alternate embodiment of the present invention.
Figure 6:
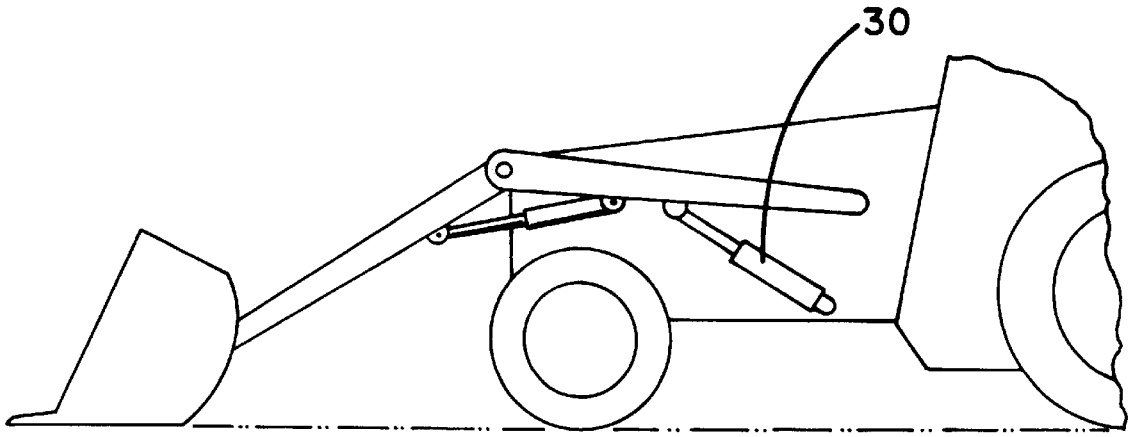
FIG. 6 is a side view of yet another embodiment of the present invention.

In various alternate embodiments, as shown in FIGS. 5 & 6, the above hydraulic arm and cross bar arc substituted with a pair of hydraulic cylinders 30 each connected between the vehicle and an associated one of the arms. Each hydraulic cylinder is adapted to function independently to afford the desired function. It should be understood that the aforementioned vehicle may take the form of a tractor, back hoe, caterpillar or any other type of construction vehicle or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tilting loader comprising, in combination:

a pair of arms each including an inboard extent pivotally coupled at an inboard end thereof to a side face of a vehicle and an outboard extent pivotally coupled at an inboard end thereof to an outboard end of the corresponding inboard extent;

a bucket including a rear portion having a rear face pivotally coupled to outboard ends of the outboard extents of the arms via a pair of universal ball and socket joints;

a rigid cross bar with a fixed length having a pair of ends pivotally coupled to a central extent of the outboard extents of the arms via a pair of universal ball and socket joints;

a hydraulic arm having a first end pivotally coupled to the inboard end of the outboard extent of a first one of the arms via a ball and socket joint and a second end pivotally coupled to the outboard end of the outboard extent of a second one of the arms via a ball and socket joint, the hydraulic arm adapted to lengthen upon the receipt of a counterclockwise tilt signal for rotating the bucket about a horizontally oriented central longitudinal axis in a counterclockwise direction, the hydraulic arm adapted to retract upon the receipt of a clockwise tilt signal for rotating the bucket about a horizontally oriented central longitudinal axis in a clockwise direction; and a control unit including a rotating lever mounted to a control panel of the vehicle and adapted to generate the counterclockwise tilt and clockwise tilt signal upon the lever being rotated to a first position and a second position, respectively.

2. A tilting loader comprising:

arm means connected to a vehicle and adapted to raise and lower;

a bucket pivotally coupled to the arm means; and tilt means for rotating the bucket about a horizontally oriented central longitudinal axis in a counterclockwise direction and rotating the bucket about the horizontally oriented central longitudinal axis in a clockwise direction;

wherein the arm means includes a pair of arms and the tilt means includes a rigid cross bar with a fixed length having a pair of ends pivotally coupled between the arms and a hydraulic arm having a first end pivotally coupled to a first one of the arms to a rear of the cross bar and a second end pivotally coupled to a second one of the arms in front of the cross bar, the hydraulic arm adapted to lengthen and retract upon the receipt of a corresponding tilt signal.

3. The tilting loader as set forth in claim 2 wherein the arm means is coupled to the bucket by way of at least one universal ball and socket joint.

4. The tilting loader as set forth in claim 2 wherein further provided is a control unit including a rotating lever mounted to a control panel of the vehicle for generating the tilt signal upon the lever being rotated.

* * * * *